US008161658B1

(12) United States Patent
Hackworth

(10) Patent No.: US 8,161,658 B1
(45) Date of Patent: Apr. 24, 2012

(54) COMBINED FABRIC MEASURING AND CUTTING JIG AND ASSOCIATED METHOD

(76) Inventor: Andrew Hackworth, Linesville, PA (US)

( * ) Notice: Subject to any disclaimer, the term of this patent is extended or adjusted under 35 U.S.C. 154(b) by 0 days.

(21) Appl. No.: 13/110,800

(22) Filed: May 18, 2011

Related U.S. Application Data

(60) Provisional application No. 61/345,690, filed on May 18, 2010.

(51) Int. Cl.
*B43L 13/00* (2006.01)

(52) U.S. Cl. ..... 33/562; 33/566

(58) Field of Classification Search ..... 33/562, 33/563, 565, 566, 17 R, 42, 484, 495
See application file for complete search history.

(56) References Cited

U.S. PATENT DOCUMENTS

| | | | | |
|---|---|---|---|---|
| 2,034,177 | A | 3/1936 | Flatt | |
| 2,316,971 | A | 4/1943 | Overacker | |
| 5,191,716 | A * | 3/1993 | Anderson | 33/483 |
| 5,511,316 | A * | 4/1996 | Fischer et al. | 33/1 F |
| 5,555,631 | A * | 9/1996 | Houston | 33/31 |
| 5,557,996 | A | 9/1996 | Reber | |
| 5,829,150 | A * | 11/1998 | McEligot | 33/562 |
| 6,182,549 | B1 * | 2/2001 | Albright et al. | 33/437 |
| 6,216,354 | B1 * | 4/2001 | Carbone | 33/565 |
| 6,895,675 | B2 * | 5/2005 | Albright et al. | 33/42 |
| 7,100,295 | B1 | 9/2006 | Chang | |
| 7,536,803 | B2 * | 5/2009 | Samuels | 33/566 |
| 8,011,111 | B2 * | 9/2011 | Brady | 33/562 |
| 2004/0143979 | A1 * | 7/2004 | Albright et al. | 33/42 |
| 2008/0052940 | A1 | 3/2008 | Manley | |
| 2009/0025245 | A1 * | 1/2009 | Brady | 33/562 |
| 2009/0026661 | A1 | 1/2009 | Sturman | |
| 2009/0229139 | A1 * | 9/2009 | Alvarez | 33/567.1 |
| 2010/0083514 | A1 * | 4/2010 | Williams | 33/27.02 |
| 2011/0048186 | A1 * | 3/2011 | Thomas et al. | 33/566 |

* cited by examiner

*Primary Examiner* — Yaritza Guadalupe-McCall

(57) ABSTRACT

A fabric measuring and cutting jig for simultaneously holding, measuring and cutting a piece of fabric preferably includes a cutting matt, a ruler pivotally connected to the cutting matt, and a pin removably positioned through two holes selected from first, second, third, fourth and fifth groups of holes, respectively, such that the ruler is pivotally displaced along the cutting matt while the proximal end of the ruler remains pivotally anchored to the pin. A fabric material is intercalated between the cutting matt and ruler wherein a cutting implement is used to cut the fabric material along a longitudinal edge of the ruler.

15 Claims, 4 Drawing Sheets

COMBINED FABRIC MEASURING AND CUTTING JIG AND ASSOCIATED METHOD

CROSS REFERENCE TO RELATED APPLICATIONS

This application claims the benefit of U.S. Provisional Application No. 61/345,690, filed May 18, 2010, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to cutting fabric and, more particularly, to a combined fabric measuring and cutting jig for providing users with an easy and convenient means of holding, measuring and cutting a piece of fabric material simultaneously and accurately.

2. Prior Art

Tailors and dressmakers generally use a set of tools including measuring tapes, rulers and marking chalks for their work. These are the "tools of the trade" important for drawing the patterns, shapes and dimensions of an apparel on a piece of fabric to be cut and sewed. The process of measuring, marking and positioning the cloth may be made on a cutting mat with dimensions marked at appropriate surface locations of the cutting mat to assist in cutting the various patterns, shapes and sizes more accurately. Tailors and dressmakers are skilled artists and such kinds of work will require a pair of steady hands as a slight movement may result in the fabric being shifted out of position and resulting in the work piece being cut out of line thereby destroying the piece of work. This task is made even more difficult by the soft and slippery fabric material which may crease and wrinkle thus making the process a very tedious and time consuming task. For the novice, even with the assistance of a cutting mat, such a task is still a daunting process with many pieces of work material rejected.

Accordingly, a need remains for an apparatus in order to overcome the above-noted shortcomings. The present invention satisfies such a need by providing a combined fabric measuring and cutting jig that is convenient and easy to use, lightweight yet durable in design, versatile in its applications, and designed for holding, measuring and cutting a piece of fabric material simultaneously and accurately.

BRIEF SUMMARY OF THE INVENTION

In view of the foregoing background, it is therefore an object of the present invention to provide a fabric measuring and cutting jig for simultaneously holding, measuring and cutting a piece of fabric. These and other objects, features, and advantages of the invention are provided by a fabric measuring and cutting jig preferably including a cutting matt, a ruler pivotally connected to the cutting matt, and a pin removably positioned through two holes selected from first, second, third, fourth and fifth groups of holes (described hereinbelow), respectively, such that the ruler is pivotally displaced along the cutting matt while the proximal end of the ruler remains pivotally anchored to the pin.

The cutting matt may include a plurality of linear edges contiguously extending along an entire perimeter of thereof as well as a plurality of graduations formed along an entire longitudinal length of the linear edges respectively. First and second groups of holes may be formed along a first linear edge of the linear edges, and a third group of holes may be formed adjacent to an intersecting corner of second and third linear edges of the cutting matt linear edges.

The ruler preferably includes a fourth group of holes formed at a proximal end of the ruler, and a fifth group of holes formed at a distal end of the ruler.

In a non-limiting exemplary embodiment, the first and second groups of holes may be configured in first and second linear rows registered parallel to each other and the first linear edge of the cutting matt, respectively.

In a non-limiting exemplary embodiment, the third group of holes may be diagonally aligned relative to the first and second linear rows.

In a non-limiting exemplary embodiment, the fourth group of holes may be arranged in a linear pattern parallel to a proximal edge of the proximal end of the ruler.

In a non-limiting exemplary embodiment, the fifth group of holes may be arranged in a linear pattern diagonally offset from a distal corner at the distal end of the ruler.

In a non-limiting exemplary embodiment, the cutting matt may have a planar top surface.

In a non-limiting exemplary embodiment, a bottom surface of the ruler preferably slides along the planar top surface of the cutting matt during articulation of the ruler.

The present invention may further include a method of utilizing a fabric measuring and cutting jig for simultaneously holding, measuring and cutting a piece of fabric. Such a method preferably includes the initial step of: providing a cutting matt may have a plurality of linear edges contiguously extending along an entire perimeter of thereof wherein the cutting matt preferably includes a plurality of graduations formed along an entire longitudinal length of the linear edges respectively. First and second groups of holes may be formed along a first linear edge of the linear edges, and a third group of holes may be formed adjacent to an intersecting corner of second and third linear edges of the linear edges.

The method further includes the chronological steps of: providing and pivotally connecting a ruler to the cutting matt wherein the ruler preferably includes a fourth group of holes formed at a proximal end of the ruler, and a fifth group of holes formed at a distal end of the ruler; providing and removably positioning a pin through two holes selected from the first, second, third, fourth and fifth groups of holes respectively; and pivotally displacing the ruler along the cutting matt while maintaining the proximal end of the ruler pivotally anchored to the pin.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 2:
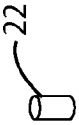
FIG. 2 is a perspective view of the pin shown in FIG. 1, which is used to pivotally connect the ruler to the cutting mat.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The apparatus of this invention is referred to generally in FIGS. 1-7 and is intended to provide a fabric measuring and cutting jig for simultaneously holding, measuring and cutting a piece of fabric. It should be understood that the present invention may be used to hold, measure and cut many different types of fabric, and should not be limited to any particular fabric material.

Referring to FIGS. 1-7 in general, a cutting matt 20, a ruler 30 pivotally connected to the cutting matt 20, and a pin 22 removably positioned through two holes selected from first 21, second 22, third 23, fourth 24 and fifth 25 groups of holes (described hereinbelow), respectively, such that the ruler 30 is pivotally displaced along the cutting matt 20 while the proximal end 33 of the ruler 30 remains pivotally anchored to the pin 22. The vertical and horizontal lines on cutting matt 20 are suitably spaced to formed one inch squares, for example. Such a structural configuration provides the unexpected and unpredictable advantage of ensuring the fabric is easily and precisely cut by securely positioning the fabric between the cutting matt 20 and ruler 30, and thereafter pivoting ruler 30 to a desired angle on the cutting matt 20 without worrying about prematurely or undesirably shifting the ruler 30 during cutting procedures. As an example, the friction between the cutting matt 20, fabric and ruler 30 ensures the ruler 30 is maintained at a desired angle for star shaped cuts on quilts.

Figure 1:
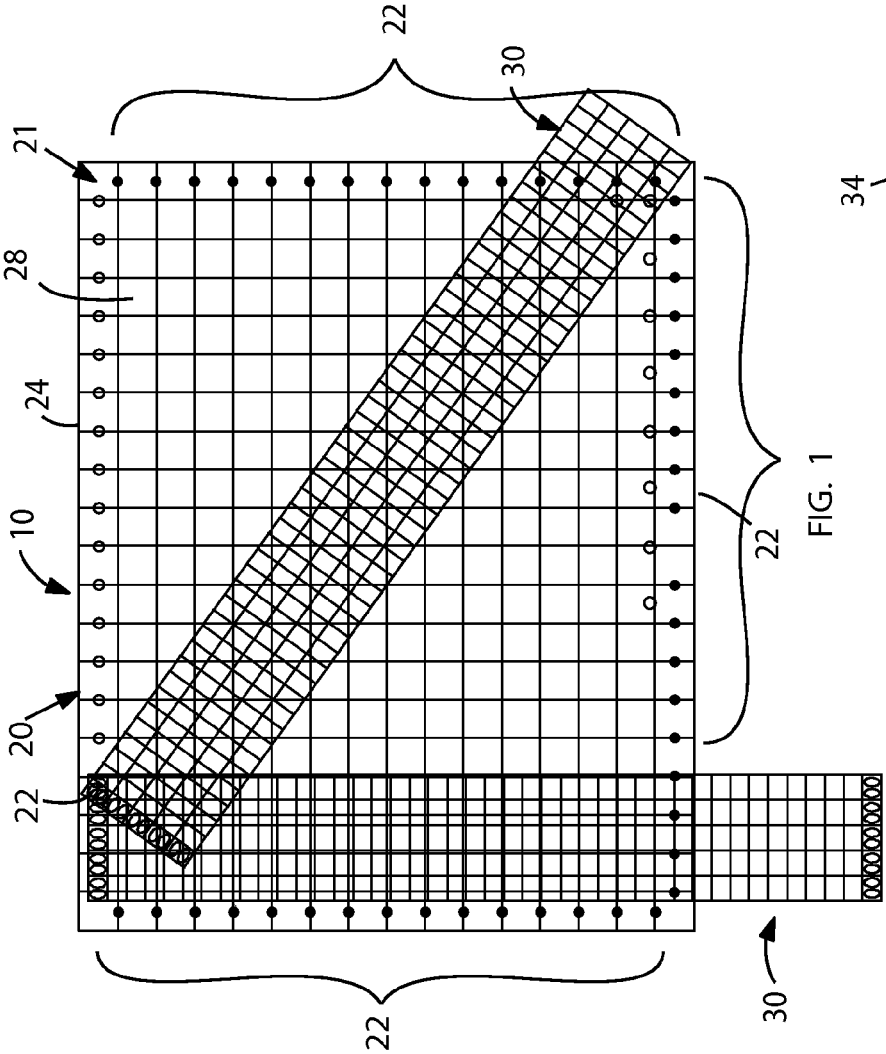
FIG. 1 is a top plan view showing a cutting matt with a ruler pivotally connected thereto, in accordance with a non-limiting exemplary embodiment of the present invention.
Figure 3:
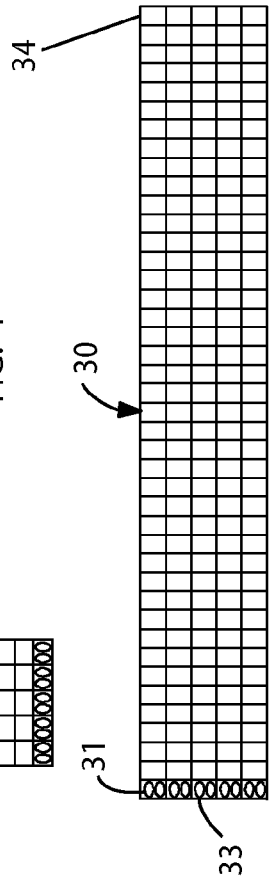
FIG. 3 is a top plan view of one embodiment of the ruler shown in FIG. 1.

In one embodiment, as perhaps best shown in FIG. 1, a plurality of pins 22 may be located along the linear edges of the cutting matt 20. Of course, one skilled in the art understands such pins 22 may be removably or permanently located on the cutting matt 20. Also, various surface indicia may be included on the cutting matt 20, as well understood by one skilled in the art.

The cutting matt 20 may include a plurality of linear edges 29 contiguously extending along an entire perimeter thereof as well as including a plurality of graduations 41 formed along an entire longitudinal length of the linear edges 29, respectively. Each graduation 41 may be spaced at a ⅛" interval, for example. First and second groups of holes 21, 22 may be formed along a first linear edge 24 of the linear edges 29, and a third group of holes 23 may be formed adjacent to an intersecting corner 27 of second and third linear edges 25, 26 of the cutting matt 20. Each group 21-23 of holes may be approximately 0.25 inches in diameter, for example. Such a structural configuration provides the unexpected and unpredictable advantage of enabling the ruler 30 to be pivotally angled and locked, via pin 22, along the cutting matt 20.

The ruler 30 may be approximately two inches long and preferably made of plastic or other material well known in the art. The ruler 30 may include a fourth group of holes 31 formed at a proximal end 33 of the ruler 30, and a fifth group of holes 32 formed at a distal end 34 of the ruler 30. Such a structural configuration provides the unexpected and unpredictable advantage of aligning the fifth group of holes 32 of the ruler 30 with the third group of holes 23 of the cutting matt 20 such that pin 22 is insertable therethrough to lock ruler 30 at a desired angle relative to the top surface 28 of cutting matt 20.

In a non-limiting exemplary embodiment, the first and second groups of holes 21, 22 may be configured in first and second linear rows registered parallel to each other and the first linear edge 24 of the cutting matt 20, respectively.

In a non-limiting exemplary embodiment, the third group of holes 23 may be diagonally aligned relative to the first and second linear rows.

In a non-limiting exemplary embodiment, the fourth group of holes 31 may be arranged in a linear pattern parallel to a proximal edge of the proximal end 33 of the ruler 30.

In a non-limiting exemplary embodiment, the fifth group of holes 32 may be arranged in a linear pattern diagonally offset from a distal corner 35 at the distal end 34 of the ruler 30.

In a non-limiting exemplary embodiment, the cutting matt 20 may have a planar top surface 28.

In a non-limiting exemplary embodiment, a bottom surface of the ruler 30 preferably slides along the planar top surface 28 of the cutting matt 20 during articulation of the ruler 30.

The present invention may further include a method of utilizing a fabric measuring and cutting jig 10 for simultaneously holding, measuring and cutting a piece of fabric. Such a method preferably includes the initial step of: providing a cutting matt 20 that may have a plurality of linear edges 29 contiguously extending along an entire perimeter of thereof wherein the cutting matt 20 preferably includes a plurality of graduations 41 formed along an entire longitudinal length of the linear edges 29, respectively. First and second groups of holes 21, 22 may be formed along a first linear edge 24 of the linear edges 29, and a third group of holes 23 may be formed adjacent to an intersecting corner 27 of second and third linear edges 25, 26 of the linear edges 29.

The method further includes the chronological steps of: providing and pivotally connecting a ruler 30 to the cutting matt 20 wherein the ruler 30 preferably includes a fourth group of holes 31 formed at a proximal end 33 of the ruler 30, and a fifth group of holes 32 formed at a distal end 34 of the ruler 30; providing and removably positioning a pin 22 through two holes selected from the first 21, second 22, third 23, fourth 31 and fifth 32 groups of holes respectively; and pivotally displacing the ruler 30 along the cutting matt 20 while maintaining the proximal end 33 of the ruler 30 pivotally anchored to the pin 22. Such a structural configuration provides the unexpected and unpredictable advantage of ensuring the fabric is easily and precisely cut by securely positioning the ruler 30 to a desired angle on the cutting matt 20 without worrying about premature or undesirable movement of the ruler 30 as the fabric is intercalated between the ruler 30 and cutting matt 20 during cutting procedures.

Figure 4:
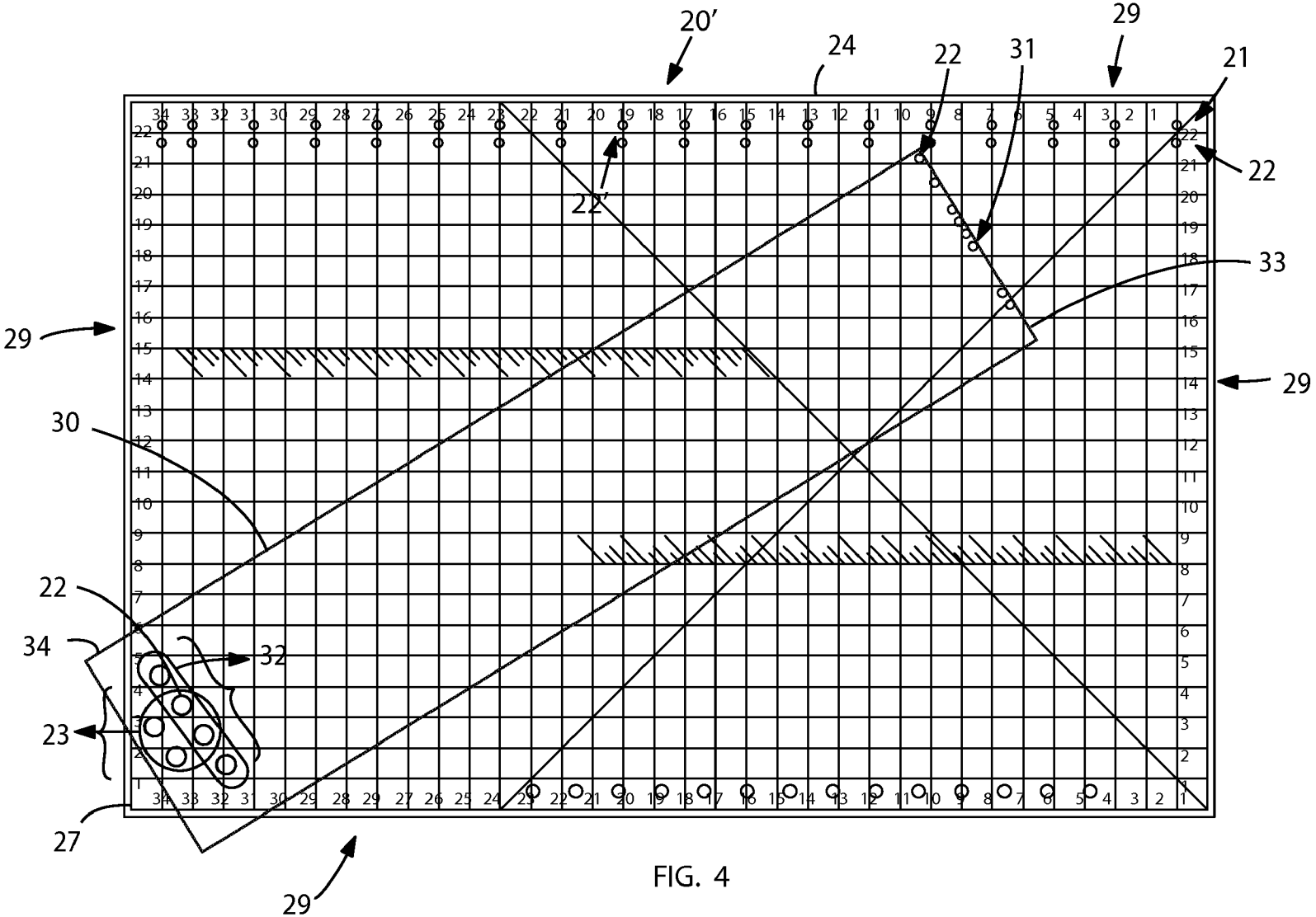
FIG. 4 is a top plan view showing an alternate embodiment of the cutting matt.
Figure 5:
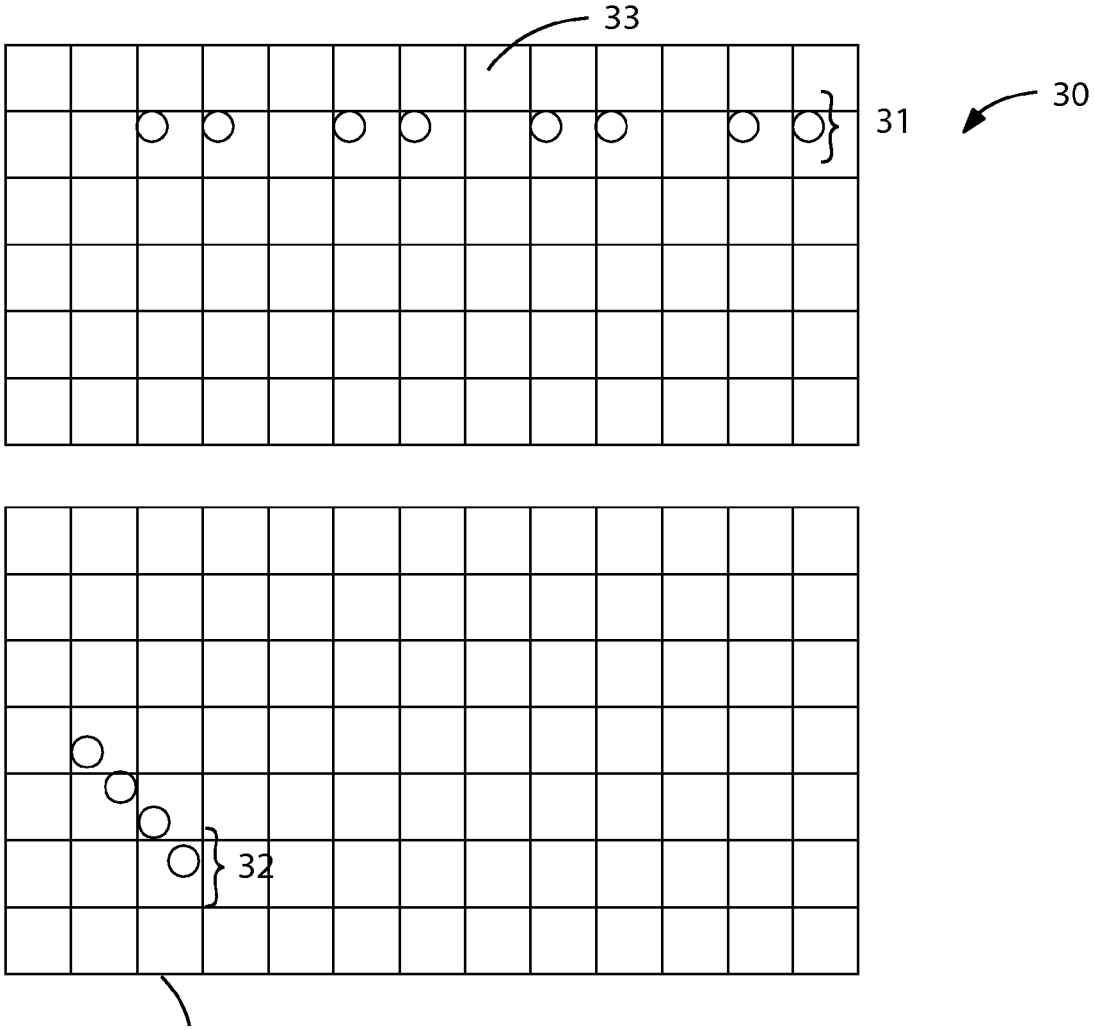
FIG. 5 is a partial view showing the arrangement of the fourth and fifth groups of holes on the ruler.
Figure 6:
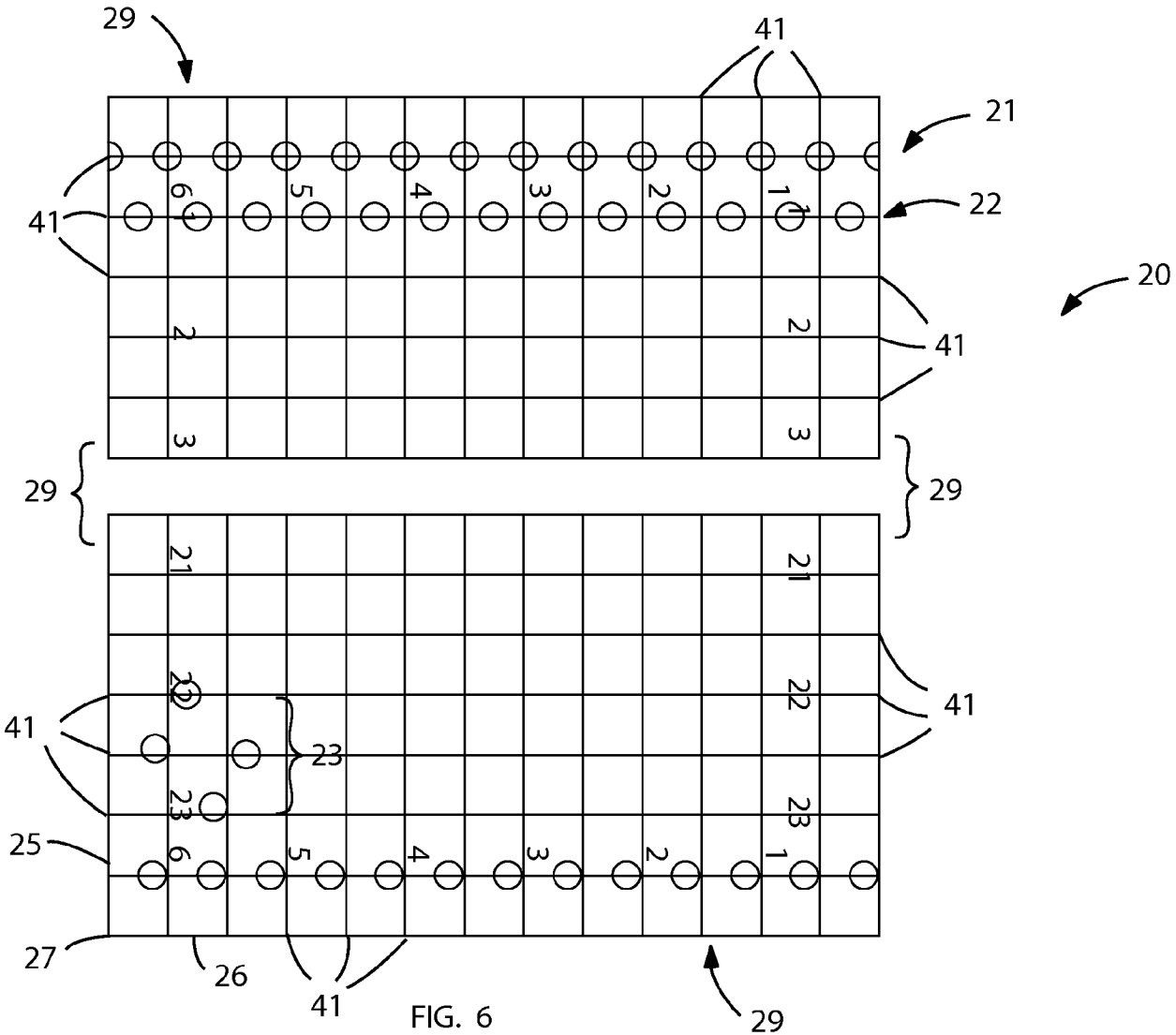
FIG. 6 is a partial view showing an arrangement of the first, second and third groups of holes on the cutting matt.

In an alternate embodiment, as perhaps best shown in FIGS. 1 and 4, a plurality of equidistantly spaced and fixedly mated pins 40 may be juxtaposed along at least one linear edge 29 of the cutting mat 20. In such embodiments, a removable pin 22 may be used to fixedly mate the distal end of the ruler 30 at the third group of holes 23 of the cutting mat 20 with the fifth group of holes 32 of the ruler 30, respectively.

In use, the combined fabric measuring and cutting jig 10 would be simple and straightforward to use. First, the user may place fabric material to be cut on the cutting matt 20 and place the ruler 30 on the fabric material. The ruler 30 may be positioned along a line to be cut by aligning one of the cutting matt holes 23 with one of the ruler holes 32 by inserting the pin 22 therethrough. Alternatively, the ruler holes 32 may be removably inserted onto the fixedly mated pins 22. The ruler 30 may be pivotally positioned on the cutting matt 20 by rotating the ruler 30 about is proximal end 33 to a desired angle on the cutting matt 20. Next, the fabric material may be firmly held between the bottom surface of the ruler 30 and the top surface 28 of the cutting matt 20 for precise measurements. The user may then hold down the ruler 30 on the fabric material with one hand and use a rotary cutter (or other cutting implement) with another hand to cut the material along the longitudinal edge of the ruler 30.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. A fabric measuring and cutting jig for simultaneously holding, measuring and cutting a piece of fabric, said fabric measuring and cutting jig comprising:

a cutting matt having a plurality of linear edges, said cutting matt including a plurality of graduations formed along said linear edges respectively, first and second groups of holes formed along a first linear edge of said linear edges, and a third group of holes formed adjacent to an intersecting corner of second and third linear edges of said linear edges;

a ruler pivotally connected to said cutting matt, said ruler including a fourth group of holes formed at a proximal end of said ruler, and a fifth group of holes formed at a distal end of said ruler; and a pin removably positioned through two holes selected from said first, second, third, fourth and fifth groups of holes respectively such that said ruler is pivotally displaced along said cutting matt while said proximal end of said ruler remains pivotally anchored to said pin.

2. The fabric measuring and cutting jig of claim 1, wherein said first and second groups of holes are configured in first and second linear rows registered parallel to each other and said first linear edge of said cutting matt respectively.

3. The fabric measuring and cutting jig of claim 1, wherein said third group of holes is diagonally aligned relative to said first and second linear rows.

4. The fabric measuring and cutting jig of claim 1, wherein said fourth group of holes is arranged in a linear pattern parallel to a proximal edge of said proximal end of said ruler.

5. The fabric measuring and cutting jig of claim 1, wherein said fifth group of holes is arranged in a linear pattern diagonally offset from a distal corner at said distal end of said ruler.

6. The fabric measuring and cutting jig of claim 1, wherein said cutting matt has a planar top surface.

7. The fabric measuring and cutting jig of claim 1, wherein a bottom surface of said ruler slides along said planar top surface of said cutting matt during articulation of said ruler.

8. A fabric measuring and cutting jig for simultaneously holding, measuring and cutting a piece of fabric, said fabric measuring and cutting jig comprising:

a cutting matt having a plurality of linear edges contiguously extending along an entire perimeter of thereof, said cutting matt including a plurality of graduations formed along an entire longitudinal length of said linear edges respectively, first and second groups of holes formed along a first linear edge of said linear edges, and a third group of holes formed adjacent to an intersecting corner of second and third linear edges of said linear edges;

a ruler pivotally connected to said cutting matt, said ruler including a fourth group of holes formed at a proximal end of said ruler, and a fifth group of holes formed at a distal end of said ruler; and a pin removably positioned through two holes selected from said first, second, third, fourth and fifth groups of holes respectively such that said ruler is pivotally displaced along said cutting matt while said proximal end of said ruler remains pivotally anchored to said pin.

9. The fabric measuring and cutting jig of claim 8, wherein said first and second groups of holes are configured in first and second linear rows registered parallel to each other and said first linear edge of said cutting matt respectively.

10. The fabric measuring and cutting jig of claim 8, wherein said third group of holes is diagonally aligned relative to said first and second linear rows.

11. The fabric measuring and cutting jig of claim 8, wherein said fourth group of holes is arranged in a linear pattern parallel to a proximal edge of said proximal end of said ruler.

12. The fabric measuring and cutting jig of claim 8, wherein said fifth group of holes is arranged in a linear pattern diagonally offset from a distal corner at said distal end of said ruler.

13. The fabric measuring and cutting jig of claim 8, wherein said cutting matt has a planar top surface.

14. The fabric measuring and cutting jig of claim 8, wherein a bottom surface of said ruler slides along said planar top surface of said cutting matt during articulation of said ruler.

15. A method of utilizing a fabric measuring and cutting jig for simultaneously holding, measuring and cutting a piece of fabric, said method comprising the chronological steps of:

providing a cutting matt having a plurality of linear edges contiguously extending along an entire perimeter of thereof, said cutting matt including a plurality of graduations formed along an entire longitudinal length of said linear edges respectively, first and second groups of holes formed along a first linear edge of said linear edges, and a third group of holes formed adjacent to an intersecting corner of second and third linear edges of said linear edges;

providing and pivotally connecting a ruler to said cutting matt, said ruler including a fourth group of holes formed at a proximal end of said ruler, and a fifth group of holes formed at a distal end of said ruler;

providing and removably positioning a pin through two holes selected from said first, second, third, fourth and fifth groups of holes respectively; and pivotally displacing said ruler along said cutting matt while maintaining said proximal end of said ruler pivotally anchored to said pin.

* * * * *